US006244823B1

(12) United States Patent
Marino et al.

(10) Patent No.: US 6,244,823 B1
(45) Date of Patent: Jun. 12, 2001

(54) DUAL POSITIONABLE OSCILLATING FAN

(75) Inventors: Frank Marino, Upton; Anatoly Ratsimor, Brighton, both of MA (US)

(73) Assignee: Holmes Products Corporation, Milford, MA (US)

( * ) Notice: Subject to any disclaimer, the term of this patent is extended or adjusted under 35 U.S.C. 154(b) by 0 days.

(21) Appl. No.: 09/338,228

(22) Filed: Jun. 22, 1999

(51) Int. Cl.[7] ..... B63H 1/28
(52) U.S. Cl. ..... 416/246
(58) Field of Search ..... 416/246; 415/126

(56) References Cited

U.S. PATENT DOCUMENTS

| | | | |
|---|---|---|---|
| 2,341,220 | 2/1944 | Jordan . | |
| 2,725,184 | 11/1955 | Mucci . | |
| 2,811,304 | 10/1957 | Russer et al. . | |
| 4,341,151 * | 7/1982 | Sakamoto | 416/247 R |
| 4,732,539 | 3/1988 | Shin-Chin | 416/100 |
| 5,018,951 * | 5/1991 | Wang | 417/423.15 |

* cited by examiner

*Primary Examiner*—John E. Ryznic
(74) *Attorney, Agent, or Firm*—Hoffmann & Baron, LLP

(57) ABSTRACT

An oscillating electric fan may be used in both a table supported position and a wall mounted position. The electric fan includes a fan unit and a pedestal for supporting the fan unit. The pedestal includes a base and an elongate fan unit support extending generally perpendicular to the base. A mounting joint is provided for moveably coupling the fan unit to the distal end of the fan unit support. The mounting joint permits pivotal tilting movement of the fan between first and second positions which define the wall mounted and table supported positions of the fan. A manually actuatable clip is engageable with the mounting joint. The clip permits movement of the fan unit from the first positions to the second positions without actuation of the clip. The clip further prevents movement of the fan unit from the second positions to the first positions without actuation of the clip.

14 Claims, 9 Drawing Sheets

DUAL POSITIONABLE OSCILLATING FAN

FIELD OF THE INVENTION

The present invention is directed to an oscillating electric fan having tilting capability. More particularly, the present invention is directed to an oscillating electric fan which may be supported on a horizontal surface such as a table or mounted to a vertical surface such as a wall.

BACKGROUND OF THE INVENTION

Portable oscillating fans are well known and commonly used to circulate air. Examples of oscillating fans include those found in U.S. Pat. Nos. 2,341,220; 2,725,184 and 2,811,304. These fans generally include a rotatable fan unit supported by a base such as a stand or a pedestal and which is arrange to oscillate about a vertical axis so as to enhance the circulation of air. In order to further enhance the air circulation capabilities of the fan, the fan unit may be further mounted for limited tilting movement both backward and forward about a horizontal axis. Such tilting of the fan unit permits the fan to more efficiently direct air circulation in a plurality of directions.

While it may be desirable provide a wide range of positions through the fan unit may be tilted, certain positions may result in the fan being unstable when supported on a horizontal surface such as a table. Applicable regulatory standards which mandate the degree of stability that a fan must maintain, such as those promulgated by Underwriters Laboratories (UL), effectively place limits on the degree to which a fan unit may be tilted with respect to the base especially in the rearward direction. These limitations on fan unit tilt, prevent inadvertent toppling of the fan when it is supported on a sloped surface such as a damaged table. UL requirements therefore dictate that the fan be operable in all modes (oscillating, non-oscillating, tilted, etc.) when supported on a 10° sloped surface. Thus, oscillating fans are currently designed so that the fan unit is restricted, to some degree, from being tilted to a position which would cause the fan to easily topple over due to its unbalanced center of gravity and thereby fail the 10° stability test.

Notwithstanding the need to limit the amount of horizontal tilt of a table supported fan unit during use, it may become necessary to tilt the fan unit with respect to the base beyond the dictated limits. In one such situation, convenient and economical packaging of the fan for transportation and sale is provided by permitting the fan unit to be collapsed forward towards the base into a smaller configuration. Such collapsing of the fan is achieved by tilting or rotating the fan unit horizontally with respect to the base beyond the typical set limits. While allowing such collapsing movement of the fan unit with respect to the base, assurances must be provided that during use the fan unit cannot be easily tilted beyond the code dictated limits. Commonly assigned U.S. Pat. No. 4,732,539 addresses this concern by providing a fan having a fan unit which may be collapsed with respect to the base for convenient packaging yet limits the amount of fan unit tilt with respect to the base during use.

In another situation, certain oscillating fans are designed for dual positioning, i.e., the fan may be supported on a horizontal surface such as a floor or table or may be mounted to a vertical surface such as a wall. In this situation, the fan unit must be moveable through a wide range of positions with respect to the base to allow for both table supported and wall mounted positioning of the fan. As a table fan, the fan unit may be generally vertically aligned with the base and when used as a wall mounted fan, the fan unit may be rotated or tilted 90° or more with respect to the base. As may be appreciated, a fan which would permit such a wide degree of fan unit tilt would not pass the applicable 10° stability test of UL if the fan is inadvertently supported on a sloped table in its wall mounted configuration. Fans which permit such wide range of fan unit tilt need to include a locking mechanism which will limit the amount of fan unit tilt in a table configuration to only those positions which provide stability and therefore pass the 10° stability test. Such a locking mechanism may be overcome by deliberate action of the user to allow movement of the fan unit to a wall mounted position. Thus the fan could not be inadvertently positioned in an unstable position during table supported use.

It is therefore desirable to provide an oscillating fan which allows movement of a fan unit with respect to the base through a wide range of angles so as to permit the fan to be used in either a table supported or wall mounted configuration and yet permit the range of motion to be restricted in a table supported configuration so as to meet applicable code regulations.

SUMMARY OF THE INVENTION

One advantage of the present invention is to provide an oscillating fan which permits the fan to be used as either a wall mounted fan or as a table supported fan.

It is a further advantage of the present invention to provide a fan having a fan unit which is rotatably supported to a base so as to permit the fan unit to be operably moveable through a wide range of angles with respect to the base so as to be useable in a wall mounted or table supported position.

It is a still further advantage of the present invention to provide a fan having a locking mechanism which restricts fan unit tilt in a table supported position so as to meet applicable stability requirements.

It is yet another advantage to provide a locking mechanism which restricts the range of motion of fan unit tilt which is bypassable by the user to allow movement to wall mountable position.

In the efficient attainment of these and other advantages, the present invention provides an electric fan including a fan unit. A pedestal is provided for supporting the fan unit. The pedestal includes a base and an elongate fan unit support extending generally perpendicular to the base. A mounting joint is provided for moveably coupling the fan unit to a distal end of the fan unit support. The mounting joint permits pivotal tilting movement of the fan unit among plural first positions and plural second positions. A manually actuatable clip is engageable with the mounting joint. The clip permits movement of the fan unit from the first positions to the second positions without actuation of the clip. The clip further prevents movement of the fan unit from the second positions to the first positions without actuation of the clip.

Preferably, the first position defines a wall mounted position and the second position defines a table supported position The clip provides a locking and unlocking position. The clip is movable from the locking position preventing movement of the fan unit from the table supported position to the wall mounted position, to the unlocking position which permits such fan unit movement.

DETAILED DESCRIPTION OF THE PREFERRED EMBODIMENTS

The present invention provides an oscillating electric fan which permits the fan to be supported on a horizontal surface such as a table or floor and also permits the mounting of the fan to a vertical surface such as a wall. Such dual positioning of the fan is achieved by providing a fan which includes a fan unit and a pedestal to which the fan unit is moveably mounted. The fan unit is tiltable with respect to the pedestal so as to permit such dual use. When employed as a table supported fan, the fan unit is prevented from being inadvertently tilted to its wall mounted position with respect to the pedestal so as to prevent the fan from toppling over due to its center of gravity.

Figure 1:
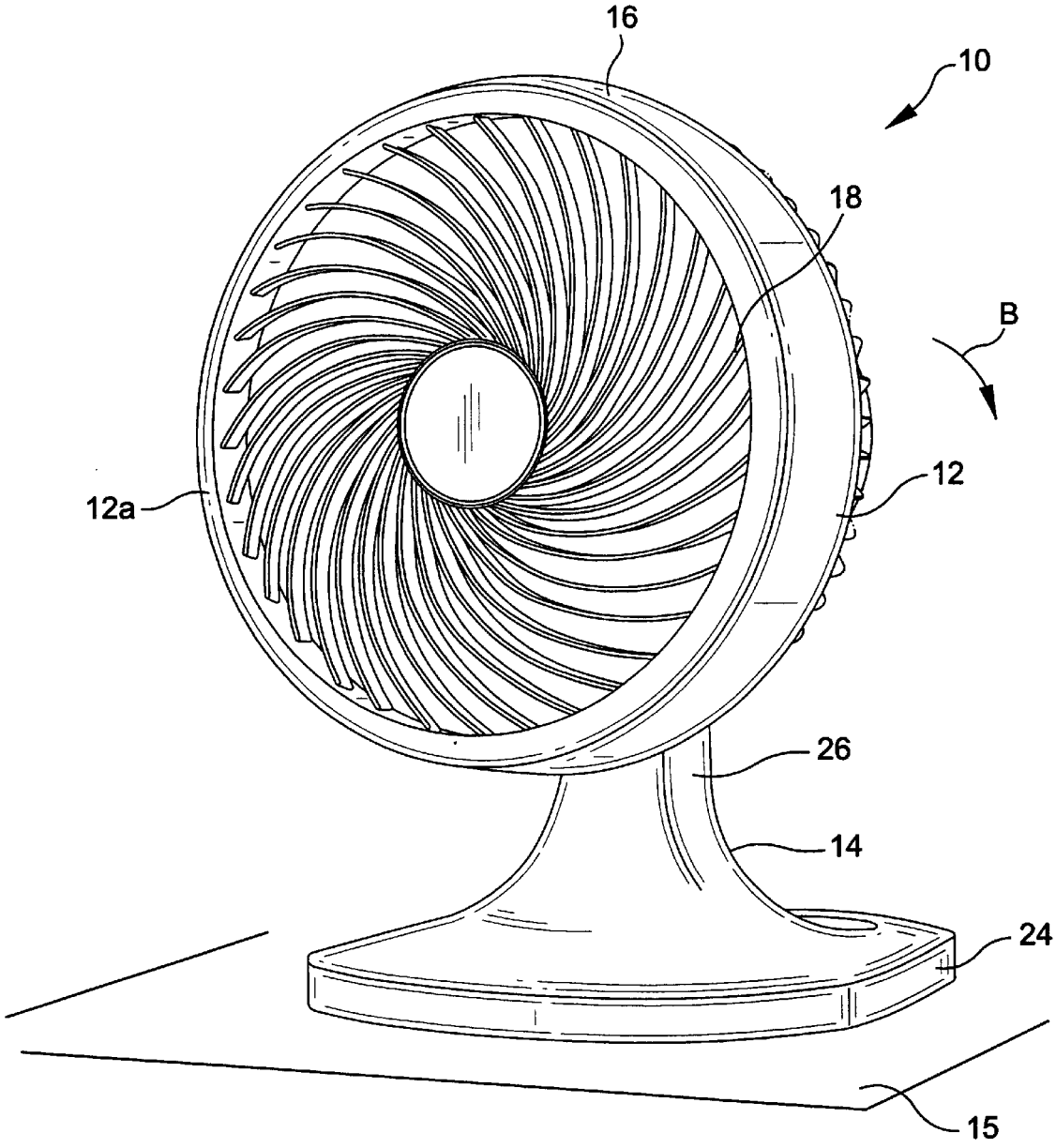
FIG. 1 is a perspective showing of an oscillating electric fan of the present invention supported on a horizontal surface such as a table.
Figure 2:
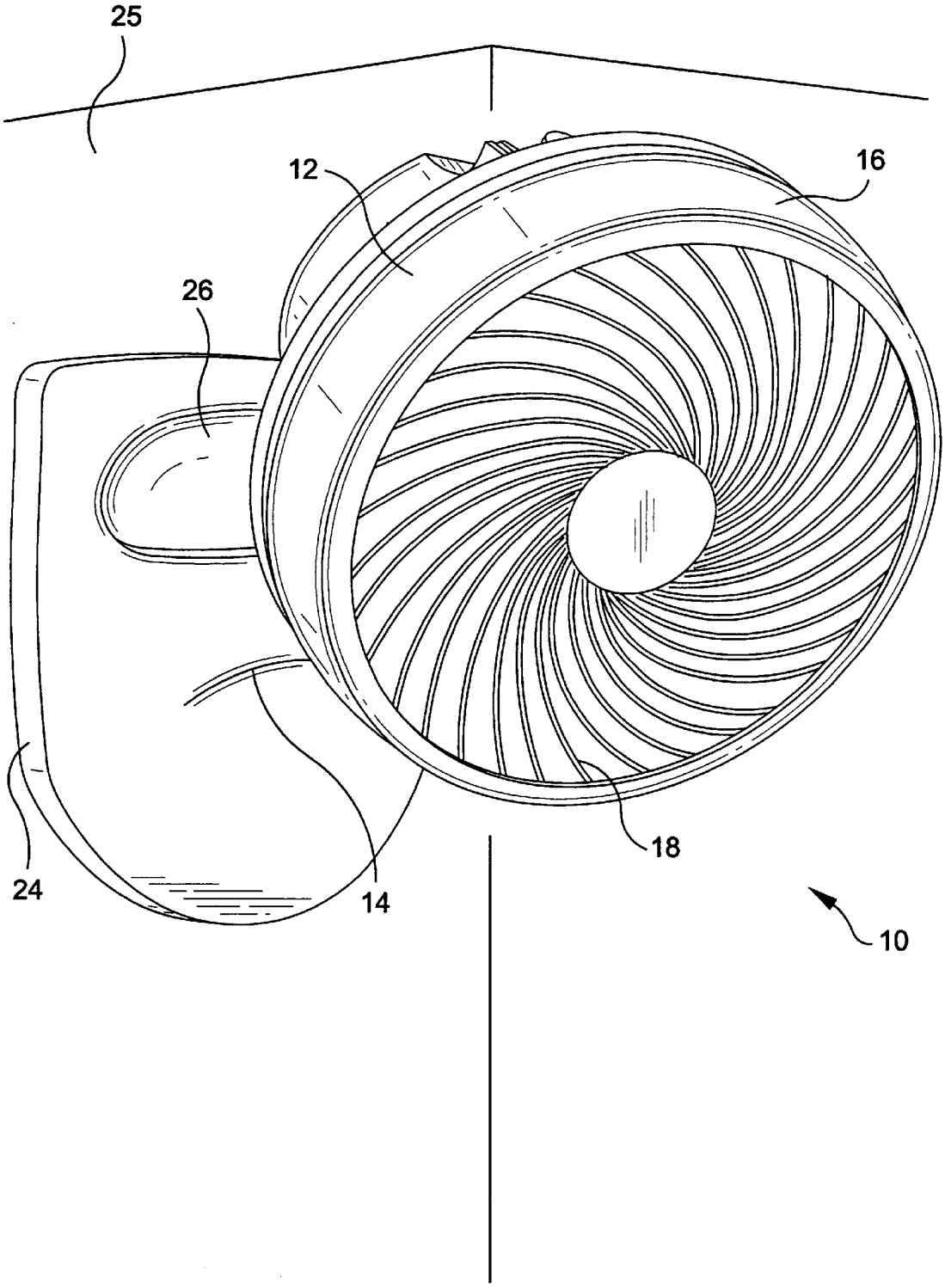
FIG. 2 is a perspective showing of the oscillating fan of FIG. 1 supported on a wall or other vertical surface.
Figure 3:
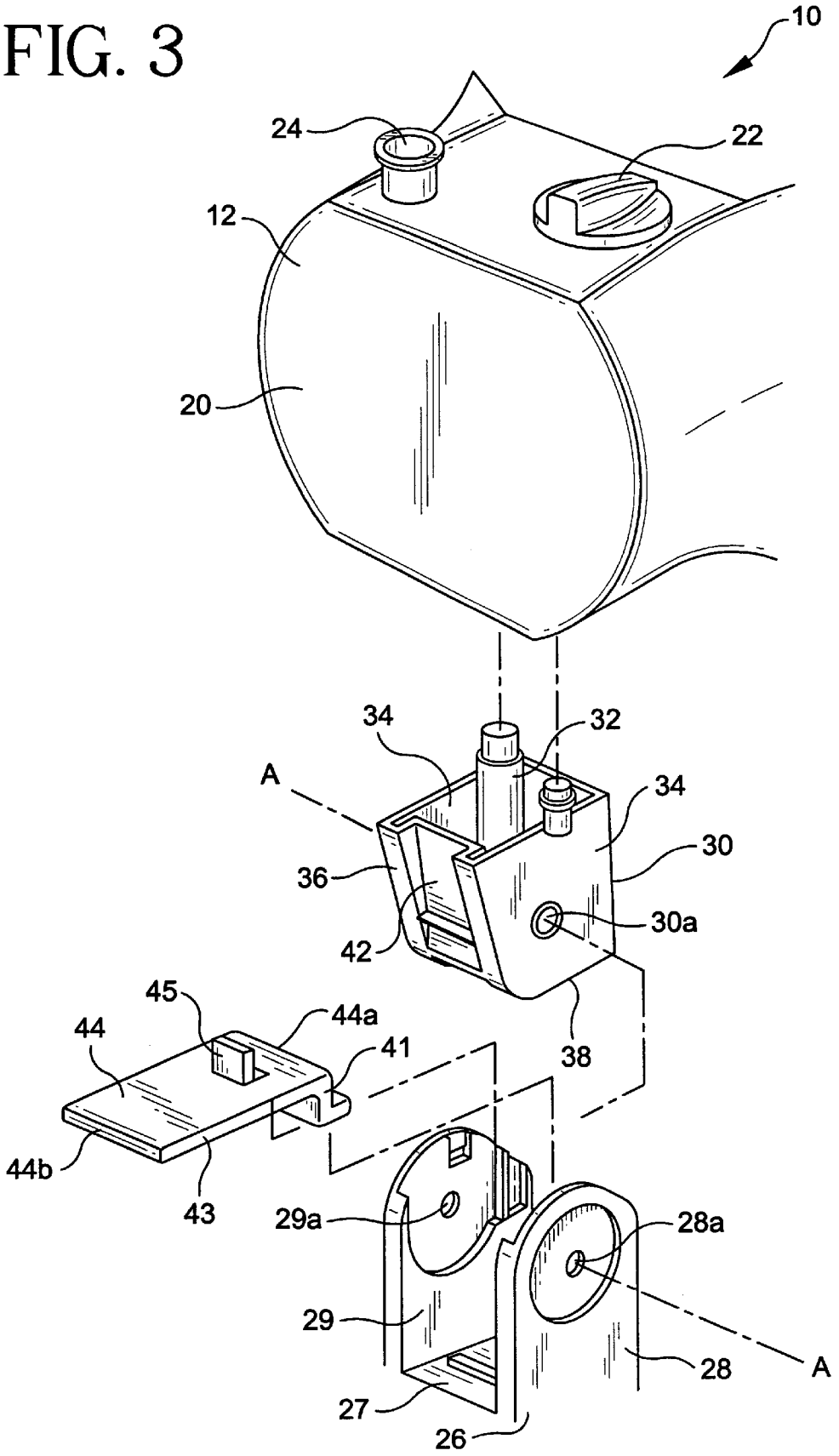
FIG. 3 is an exploded perspective view of a portion of the oscillating fan of FIGS. 1 and 2 showing the coupling of a fan unit to a pedestal.

Referring now to FIGS. 1–3 of the drawings, fan 10 of the present invention is shown. Fan 10 is an oscillating electric fan including a fan unit 12 and a pedestal 14. The fan unit 12 includes a generally cylindrical housing 16 which supports a plurality of fan blades (not shown) enclosed within a safety grill 18. As shown in FIG. 3, housing 16 includes an extending rear portion 20 which houses an electric motor (not shown). The electric motor, which is operable by a switch 22, provides for multi-speed rotation of the fan blades. Also in conventional fashion, the fan unit 12 is designed for oscillation generally horizontally about the pedestal 14, the oscillation being controlled by an actuatable button 24 also supported by rear portion 20 of housing 16.

Pedestal 14 of fan 10 includes a generally planar base 24 of size sufficient to provide stability both in a position where the fan is supported on a table 15 or in a position mounted on a wall 25. Base 24 further includes an upwardly projecting fan unit support 26. The fan unit support 26 terminates at its distal end in a distal mounting surface 27 and pair spaced apart upwardly extending ears 28 and 29.

Fan 10 further includes a mounting joint 30 positioned between fan unit 12 and pedestal 14. Mounting joint 30 moveably couples fan unit 12 to pedestal 14. In conventional fashion, fan unit 12 may oscillate in a horizontal plane as viewed in FIGS. 1 and 3 about a central vertical axle 32 of mounting joint 30 so as to permit oscillation of the fan unit 12 with respect to the pedestal 14. The mounting joint 30 further moveably supports fan unit 12 to pedestal 14 so as to permit tilting movement of fan unit 12 with respect to pedestal 14 about a horizontal axis A shown in FIG. 3. Such tilting movement of fan unit 12 with respect to pedestal 14 allows the fan unit to be positioned at multiple angles with respect to pedestal 14. Furthermore, the tilting movement of fan unit 12 allows the fan unit to be positioned with respect to the pedestal in both a table supported position shown in FIG. 1 as well as a wall mounted position shown in FIG. 1.

As shown in FIG. 3, mounting joint 30 is coupled to upstanding fan unit support 26 between spaced apart ears 28 and 29. A fastening bolt (not shown) or other similar fastening device may be inserted through holes 28*a* and 29*a* respectively of ears 28 and 29 as well as through a central passage 30*a* of mounting joint 30 aligned along axis A, to permit the pivotal movement of mounting joint 30 thereabout. As is commonly known and as will be described in further detail with respect to FIGS. 4–7, ears 28 and 29 each support a disc 50 which operates with additional hardware (not shown) so as to couple mounting joint 30 to ears 28 and 29 in a manner which allows the mounting joint 30 to be tiltable through a plurality of distinct positions about axis A.

Referring now to FIGS. 3–7, mounting joint 30 is a generally a parallelepiped shaped member having a pair of opposed side walls 34 through which central aperture 30*a* extends. Mounting joint 30 further includes a back wall 36 and an adjacent bottom wall 38 between side walls 34. The back wall 36 and the bottom wall 38 are positioned so as to move adjacent the distal mounting surface 27 of upstanding fan support 26 extending between mounting ears 28 and 29. Mounting joint 30 further includes an elongate continuous channel 42 extending through both back wall 36 and bottom wall 38. Channel 42 is generally rectangular in cross-sectional configuration, however, other channel configurations may also be employed in accordance with the present invention.

Interposed between upstanding fan support 26 and mounting joint 30 is a tilt regulating clip 44. Clip 44 includes an elongate generally planar member 43 having an L-shaped extension 41 depending from one end 44*a* thereof The clip 44 may be mounted to the distal surface 27 of upstanding fan support 26 by securing the L-shaped extension 41 to the distal surface 27 so that planar member 43 extends in a cantilevered fashion. The L-shaped extension 41 may be secured by screws (not shown) or other fastening hardware. While a separate clip is shown interposed between fan unit support 26 and mounting joint 30, clip 44 could be integrally molded to fan unit support 26. Alternatively, clip 44 may be molded with or affixed to mounting joint 30. In the preferred embodiment, the mounting of clip 44 to distal surface 27 in a manner shown in FIGS. 4–7 positions planar member 43 at a location spaced from distal surface 27. Also, end 44*b* of planar member 43, opposite end 44*a*, extends exteriorly of distal surface 27 for manual actuation as will be described hereinbelow.

Planar member 43 of clip 44 further includes a centrally located protrusion 45 extending upwardly therefrom at a location adjacent end 44*a*. Protrusion 45 is positionable within the channel 42 of mounting joint 30 when the mounting joint is secured between the ears 28 and 29 as shown in FIG. 3. Upon tilting rotation of mounting joint 30 with respect to upstanding fan support 26, the protrusion 45 will ride within channel 42. Channel 42 further includes a pair of spaced apart detents 46 and 48 extending thereacross. Detents 46 and 48 are engageable in an abutting fashion with protrusion 45 of clip 44 upon tilting movement of mounting joint 30. Detents 46 and 48 define first and second channel sections 42*a* and 42*b* in which protrusion 45 may reside. The clip 44 and its movement within channel 42 defines a locking mechanism which prevents inadvertent movement of fan unit 12, yet may be overcome to provide for movement of fan unit 12.

Figure 4:
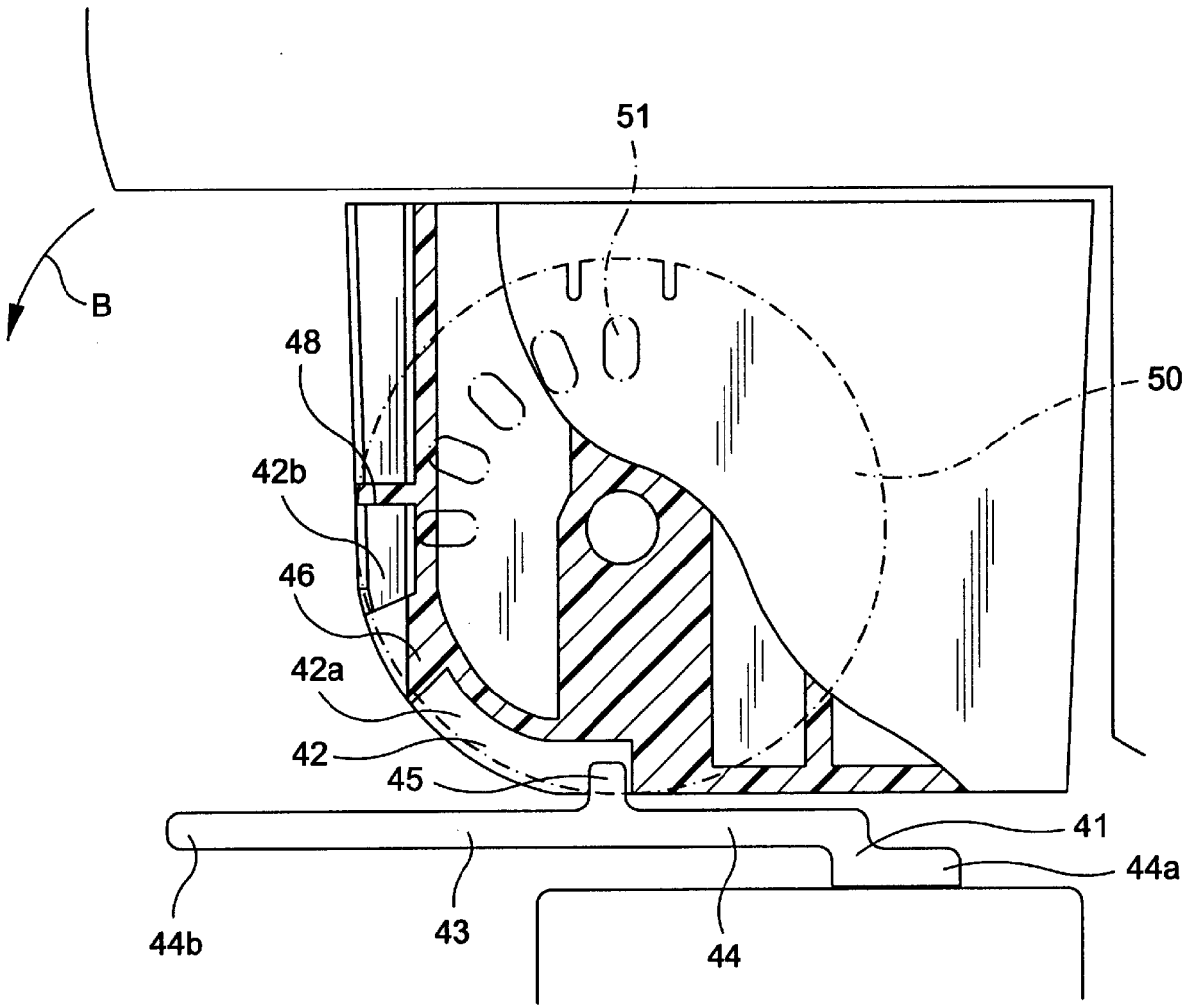
FIG. 4 is a schematic view, partially in section, of the coupling of the fan unit to the pedestal with the fan positioned for table support as shown in FIG. 1.
Figure 5:
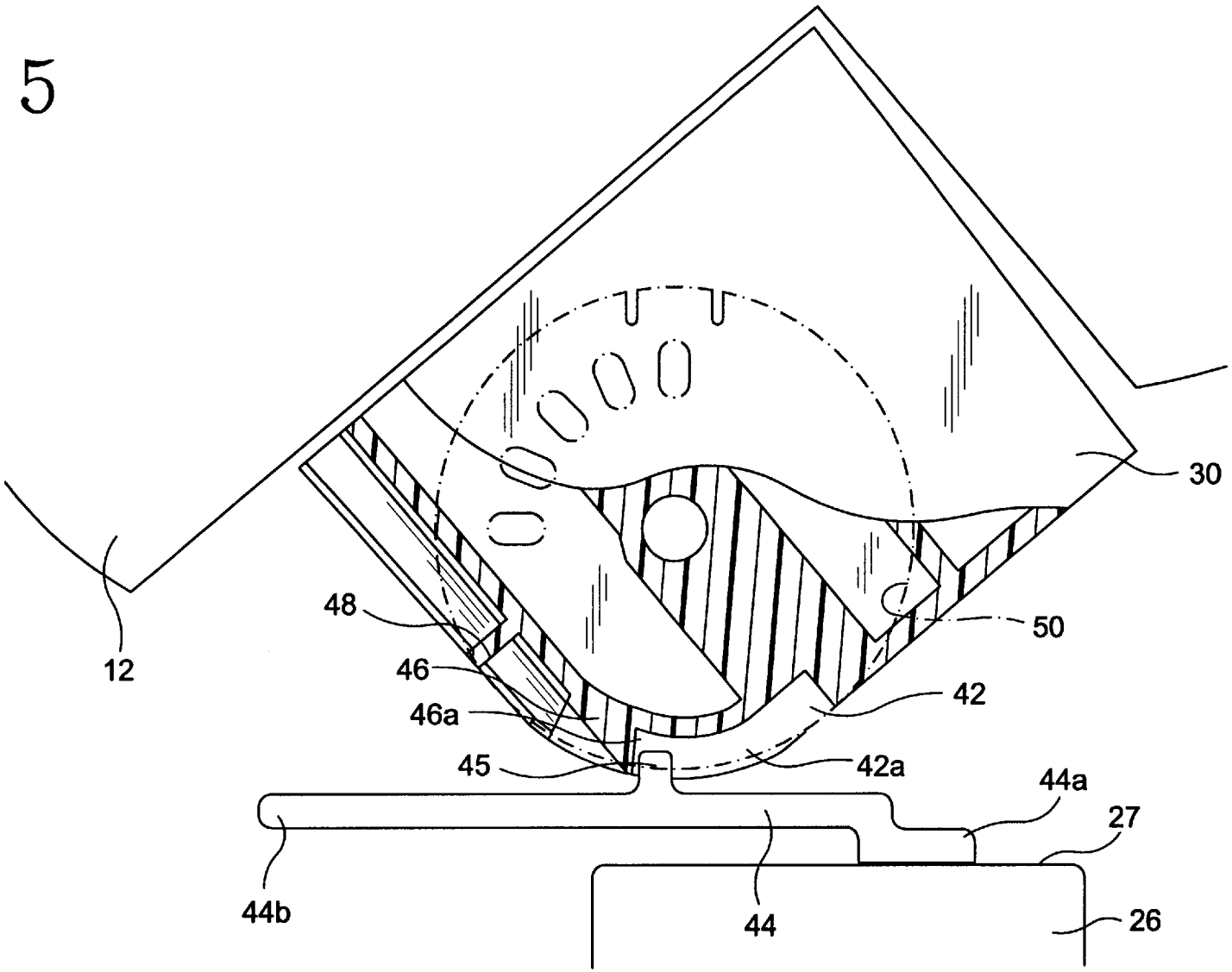
FIG. 5 is a schematic view, partially in section, of the fan unit of FIG. 1 tilted with respect to the base to a further table supported position.
Figure 9:
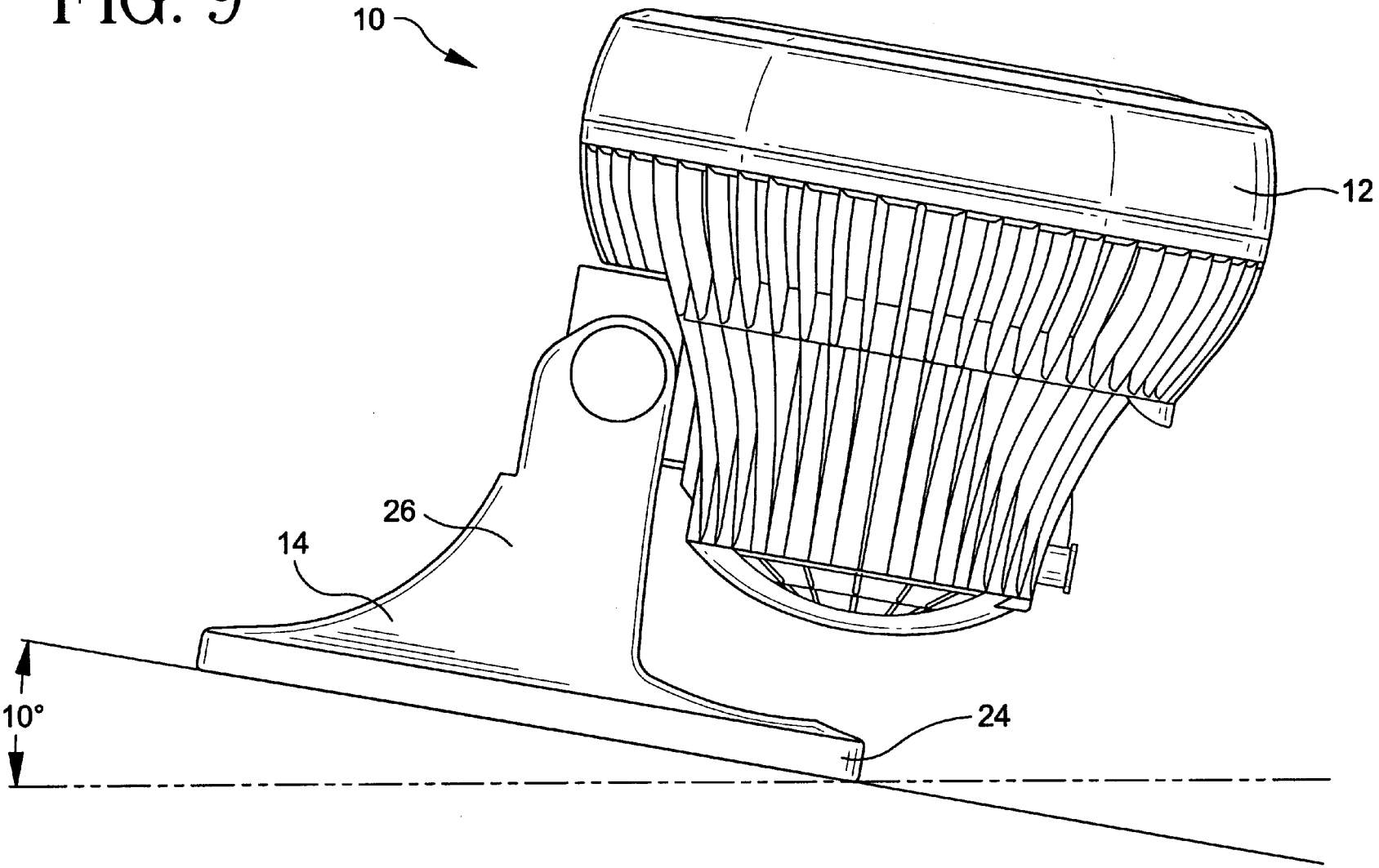
FIG. 9 is a side electrical showing of the fan of FIG. 1 configured in the wall mounted position and positioned on a 10° sloped surface.

With reference to FIGS. 1, 4 and 5, the fan is shown in its table supported position. The front face 12*a* of fan unit 12 is positioned generally in line with the upstanding fan unit support 26. The fan unit 12 may be tilted rearwardly in the direction of arrow B so as to tilt the fan unit backward, directing the front face 12*a* in a more upwardly direction. Coupling hardware including ear discs 50 positioned on internal surfaces of ears 28 and 29 allow fan movement in plural distinct table supported positions, each such position being defined by one of the spaced apart recesses 51 of disc 50. In each of the table supported positions, protrusion 45 rides within first channel section 42*a*. As shown in FIG. 5, the fan unit 12 may be tilted rearwardly until the upwardly extending protrusion 45 engages a flat wall 46*a* of first detent 46 extending across channel 42. At that point, further rearward tilting of fan unit 12 with respect to upstanding fan unit support 26 is prevented by the engagement between protrusion 45 and detent 46. The positioning of clip 44, with protrusion 45 being in engagement with detent 46, defines a locking position which prevents further tilting of mounting joint 30 and thereby fan unit 12. The prevention of further tilting movement of fan unit 12 prevents the fan unit from being inadvertently moved to a unstable position, where due to the center of gravity, the fan would topple over when supported on a sloped surface. The inadvertent tilting of fan unit 12 to a position shown in FIG. 9, would result in the fan not meeting the UL 10° stability requirement.

Figure 7:
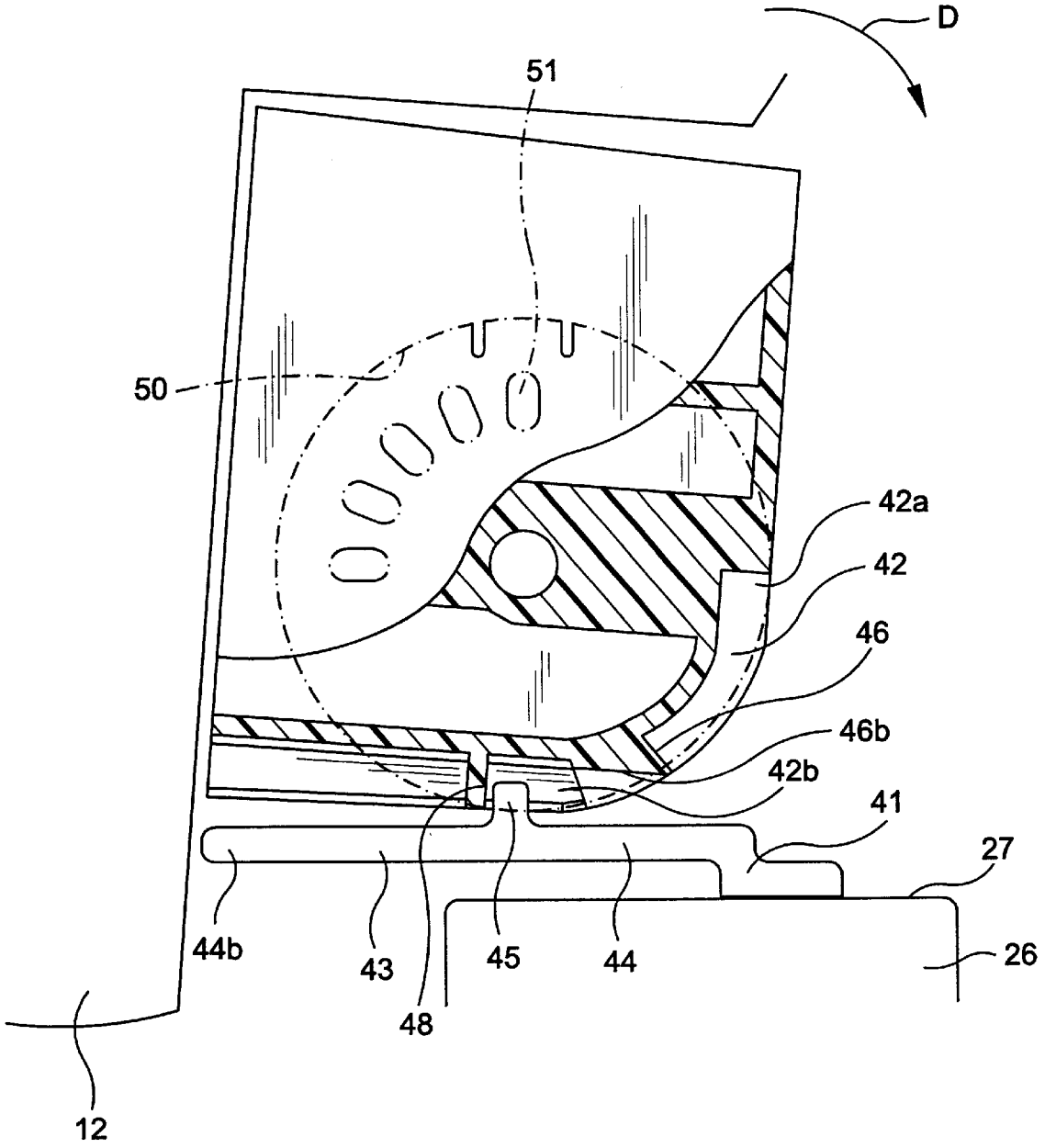
FIG. 7 is a schematic view, partially in section, of the fan positioned for wall mounting as shown in FIG. 2.
Figure 8:
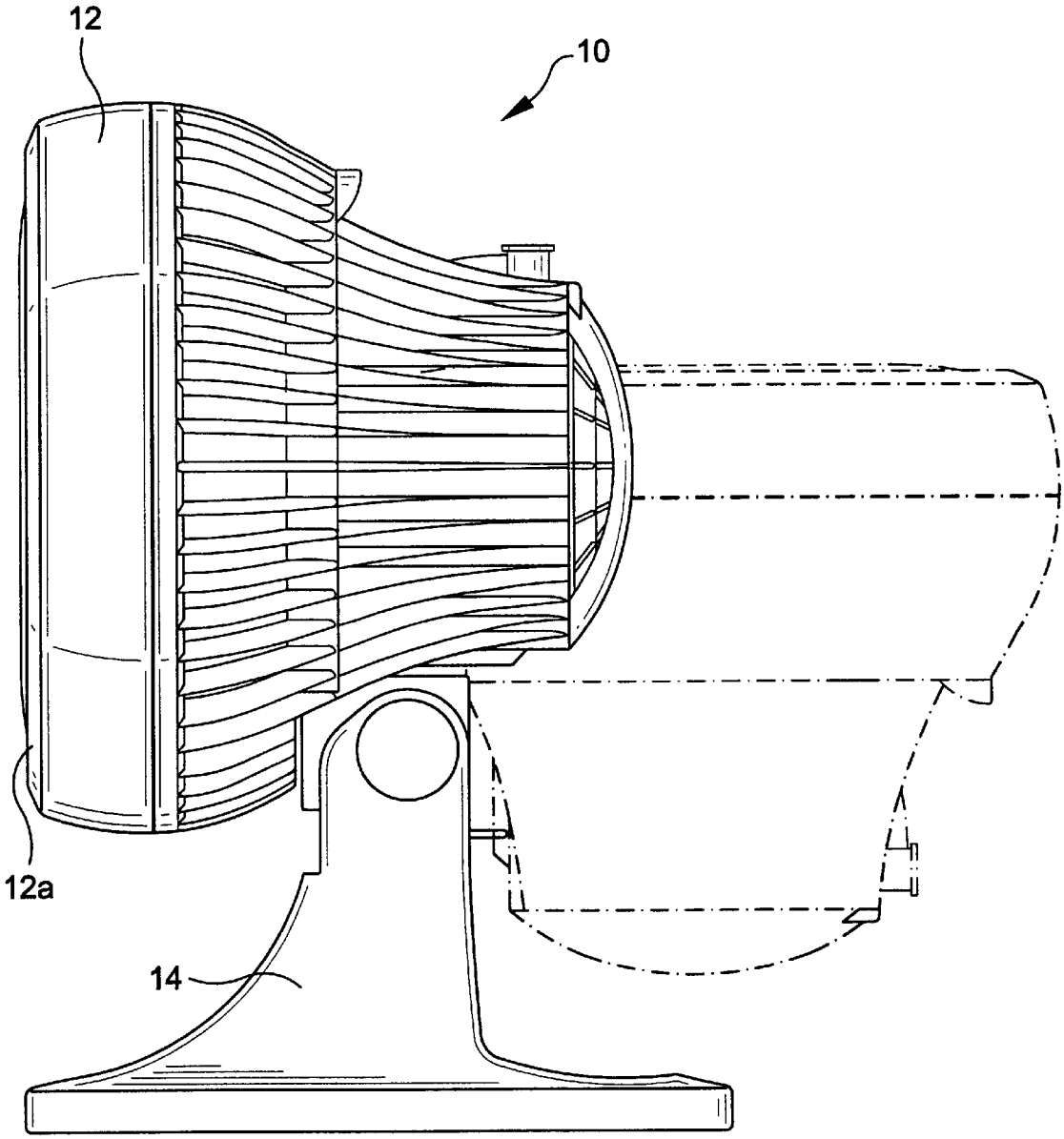
FIG. 8 is a side electrical shown of the oscillate fan of FIG. 1 in the table support configuration with the wall mounted configuration shown in phantom.

Notwithstanding the need to limit the range through which the fan unit 12 may be tilted with respect to the pedestal 14, the present invention also provides the ability to overcome the engagement between protrusion 45 and detent 46 and deliberately further tilt fan unit 12 to a position shown in FIGS. 2 and 7, where the fan unit 12 is more transverse with respect to upstanding fan unit support 26. This permits the fan unit to be used in a position mounted on a vertical surface such as a wall 25. As shown in FIG. 8 the fan unit 12 is thereby movable between a table supported position and a wall mounted position shown in phantom.

Figure 6:
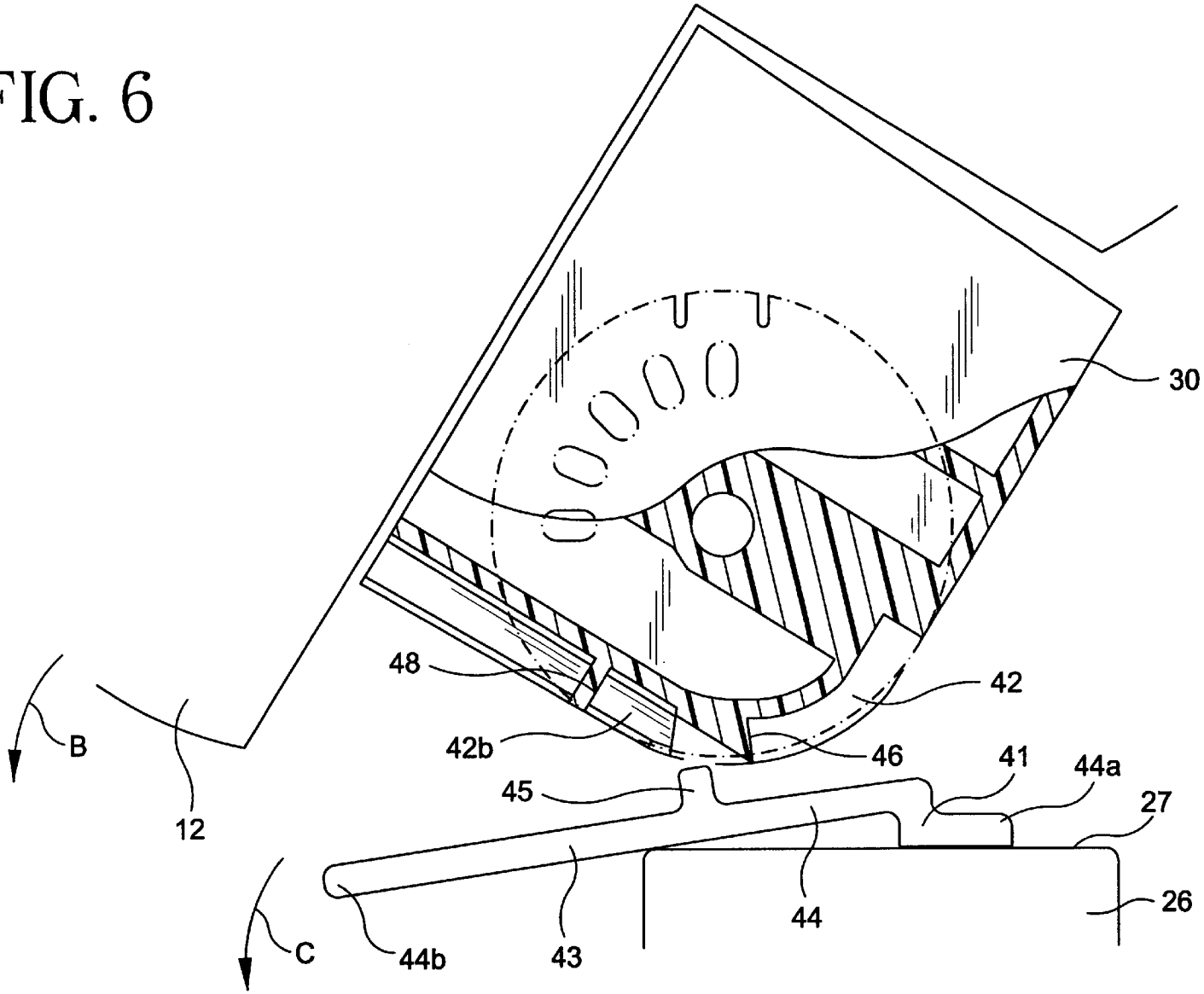
FIG. 6 is a schematic view, partially in section, of the fan unit of FIG. 1 tilted with respect to the base beyond the position shown in FIG. 5.

With reference to FIGS. 5 and 6, in order to move fan unit 12 to a wall mounted position it is necessary to move the protrusion 45 out of channel 42*a* and its interference relationship with detent 46. To do this, clip 44 is moved to an unlocking position by deliberately depressing the distal end 44*b* thereof in a cantilevered fashion in the direction of arrow C. Such deflectable movement of clip 44 moves protrusion 45 out from channel 42*a* so that it can clear detent 46 and unlock mounting joint 30. This allows the mounting joint 30 to be further tilted backwards in direction of arrow B once the protrusion 45 passes detent 46 as shown in FIG. 6. The depression of clip 44 can then be released so that the protrusion 45 again resides within channel 42*b* rearward of detent 46 as shown in FIG. 7. The fan unit 12 can be further moved in a rearward direction to plural distinct wall mounted positions also defined by recesses 51 of disc 50. As shown in FIG. 7, the fan unit can be tilted until protrusion 45 riding in channel 42*b* engages second detent 48 which prevents further rearward tilting of fan unit 12 beyond the position shown. It is contemplated that second detent 48 maybe engageable with protrusion 45 even where clip 44 is deflected so that further rearward movement of fan unit is prevented.

With the fan unit positioned in its wall mounted position is shown in FIGS. 2 and 7, if desired, the fan unit can be again moved back to its table supported position shown in FIGS. 1 and 4. Such movement may be accomplished by tilting fan unit 12 in the direction of arrow D of FIG. 7 which is opposite of arrow B shown in FIG. 6. Upon such movement, the protrusion 45 of clip 44 will ride in channel 42*b*. Protrusion 45 will then engage a ramped surface 46*b* of detent 46 opposite wall 46*a* to cause clip 44 to deflect as protrusion 45 rides over detent 46. The deflection of clip 44 is achieved without need to depress end 44*b* of clip 44. Fan unit 12 is thereby returnable to the position shown in FIG. 2 with the protrusion 45 residing within the channel 42*a*. Thus, the fan unit can easily be moved from the wall mounted position shown in FIG. 2 to the table position shown in FIG. 1 without need to actuate clip 44.

Thus, it may be appreciated that fan unit 12 may be moved from the wall mounted positions to the table supported positions without the requirement of separately manually actuating clip 44. Due to the specific construction of detent 46, however, the fan unit can not be moved from the table supported positions of FIG. 1 to the wall mounted positions of FIG. 2 unless the clip 44 is initially and deliberately manually actuated. Thus the fan unit 12 is easily moveable from a plurality of first positions defined as wall mounted positions to a plurality of second positions defined at table supported positions without actuation of the clip. Movement of the fan unit from the plurality of second table mounted positions to the plurality of first wall mounted positions is restricted unless the clip is deliberately actuated.

Various other modifications to the foregoing disclosed embodiments will now be evident to those skilled in the art. Thus, the particularly described preferred embodiments are intended to be illustrative and not limited thereto. The true scope of the invention is set forth in the following claims.

What is claimed is:

1. An electric fan comprising:

an operable fan unit;

a pedestal for supporting said fan unit on a vertical surface and on a horizontal surface, said pedestal including a base and an elongate fan unit support extending generally perpendicular to said base;

a mounting joint for moveably coupling said fan unit to a distal end of fan unit support, said mounting joint permitting pivotal movement of said fan unit among plural operable first positions with said fan unit being positioned generally transverse to said fan unit support for supporting said pedestal on said vertical surface, and permitting movement among plural operable second positions with said fan unit being positioned generally inline with said fan unit support to support said pedestal on said horizontal surface; and a manually actuatable clip engageable with said mounting joint, said clip permitting movement of said fan unit from said first positions to said second positions without actuation of said clip and preventing movement of said fan unit from said second positions to said first positions without actuation of said clip.

2. An electric fan of claim 1 wherein said clip is mountable on said distal end of fan unit support and is operably engageable with said mounting joint.

3. An electric fan of claim 2 wherein said mounting joint includes a first detent and wherein said clip includes an extending protrusion engageable with said first detent to restrict said movement of said fan unit from said second positions to said first positions.

4. An electric fan of claim 3 wherein said clip is deflectably actuatable to move said extending protrusion from engagement with said first detent to permit movement of said fan unit from said second positions to said first positions.

5. An electric fan of claim 3 wherein said clip is an elongate member having a first end extending from said fan unit support and a second end having said protrusion extending therefrom, said clip being mounted adjacent said second end for deflectable movement thereabout.

6. An electric fan of claim 5 wherein said mounting joint includes a channel with said first detent extending across said channel, wherein said protrusion extends into said channel for engagement with said first detent.

7. An electric fan of claim 3 wherein said mounting joint further includes a second detent spaced from said first detent for engagement with said protrusion both with and without actuation of said clip so as to prevent continued movement of said fan unit from said second positions beyond said first positions.

8. An electric fan of claim 6 wherein said first detent includes a first detent wall engageable with said protrusion upon movement of said fan unit from said second position to said first position, and an opposed ramp wall for engagement with said detent upon movement of said fan unit from said first positions to said second positions.

9. An electric fan of claim 5 wherein said clip includes an L-shaped extension adjacent said second end of said mounting clip for mounting said mounting clip to said distal end of said fan unit.

10. An electric fan comprising:

an operable fan unit;

a pedestal for supporting said fan unit, said pedestal defining a base surface and a fan unit support;

a mounting joint for moveably coupling said fan unit to said fan unit support, said mounting joint permitting pivotal movement between said fan unit and said pedestal among at least one operable forward table position wherein said fan unit is substantially parallel to said base surface and at least one operable rearward wall-mount position wherein said fan unit is substantially perpendicular to said base surface; and a manually actuatable clip engageable with said mounting joint and having locking and unlocking positions, said clip permitting movement of said fan unit between said forward table position and said rearward wall mount position in said unlocking position and preventing movement of said fan unit from said forward table position to said rearward wall-mount position in said locking position.

11. An electric fan of claim 10 wherein said clip is interposed between said fan unit support and said mounting joint.

12. An electric fan of claim 11 wherein said clip is mountable on said fan unit support and is engageable with said mounting joint in said locking position.

13. An electric fan of claim 12 wherein said clip is deflectably actuatable to move from said locking position to said unlocking position.

14. An electrical fan of claim 10 wherein said fan unit is moveable from said rearward wall mount position to said forward table position in said locking position.

* * * * *